US009816312B2

(12) United States Patent
Ivasiv et al.

(10) Patent No.: US 9,816,312 B2
(45) **Date of Patent: *Nov. 14, 2017**

(54) MOLDED PLASTIC ACCESS DOOR

(71) Applicant: IVM Homestyle Ltd., Mississauga (CA)

(72) Inventors: Vitaliy Ivasiv, Mississauga (CA); Igor Ivasiv, Mississauga (CA)

(73) Assignee: IVM Homestyle Ltd., Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/523,472

(22) Filed: Oct. 24, 2014

(65) Prior Publication Data

US 2015/0225995 A1 Aug. 13, 2015

Related U.S. Application Data

(63) Continuation of application No. 12/722,383, filed on Mar. 11, 2010, now Pat. No. 8,869,458.

(51) Int. Cl.
*E05C 21/02* (2006.01)
*E06B 5/01* (2006.01)
(Continued)

(52) U.S. Cl.
CPC ..... *E06B 5/01* (2013.01); *E05B 61/00* (2013.01); *E05B 65/006* (2013.01); *E05C 3/042* (2013.01);
(Continued)

(58) Field of Classification Search
CPC ... E06B 5/01; E06B 3/70; E05D 11/00; E05B 61/00; E05B 65/006
(Continued)

(56) References Cited

U.S. PATENT DOCUMENTS 1,925,635 A 9/1933 Cyril
2,100,928 A * 11/1937 Way ..... E05D 3/186 16/358
3,130,651 A 4/1964 Werner
4,105,136 A 8/1978 May
4,106,236 A * 8/1978 Oliphant ..... B60J 9/02 49/141
(Continued)

FOREIGN PATENT DOCUMENTS

EP 1582656 10/2005
GB 2185053 7/1987

OTHER PUBLICATIONS

2006 Camec Catalogue, pp. 174-176.

*Primary Examiner* — Jerry Redman
(74) *Attorney, Agent, or Firm* — Bereskin & Parr LLP/S.E.N.C.R.L., s.r.l.

(57) ABSTRACT

A molded access door assembly for an access opening in a wall or ceiling is provided. It includes a molded frame with a frame channel forming the outside of the access door assembly. The frame channel has spaced apart exterior and interior walls joined at the top edge by a top wall and a lip extending from the bottom edge of the inner wall into the interior of the molded access door assembly to define an opening. The lip provides a stop rest for the door in the closed position so that the door is capable of being attached to the wall or ceiling. The assembly also includes a door having a top surface and a first part of a hinge assembly along one edge of the top surface which cooperates with a matching second part of the hinge assembly along one edge of the frame channel to allow the door to move between an open and a closed position.

26 Claims, 4 Drawing Sheets

(51) Int. Cl.

| | |
|---|---|
| ***E05C 3/04*** | (2006.01) |
| ***E05B 61/00*** | (2006.01) |
| ***E05B 65/00*** | (2006.01) |
| ***E05D 11/00*** | (2006.01) |
| ***E06B 3/70*** | (2006.01) |
| *E05D 1/06* | (2006.01) |
| *E05D 9/00* | (2006.01) |
| *E06B 7/22* | (2006.01) |

(52) U.S. Cl.
CPC ..... *E05D 11/00* (2013.01); *E06B 3/70* (2013.01); *E05D 1/06* (2013.01); *E05D 9/005* (2013.01); *E05Y 2900/132* (2013.01); *E06B 7/22* (2013.01); *E06B 2003/7082* (2013.01)

(58) Field of Classification Search
USPC ..... 49/397, 400, 463, 465, 501, 503; 52/32, 52/65
See application file for complete search history.

(56) References Cited

U.S. PATENT DOCUMENTS

| | | | | |
|---|---|---|---|---|
| 4,280,434 | A * | 7/1981 | Beckerer, Jr. | 114/174 |
| 4,846,089 | A * | 7/1989 | Cedergreen | 114/201 R |
| 4,915,638 | A | 4/1990 | Domian | |
| D348,316 | S | 6/1994 | Malmanger et al. | |
| 5,327,682 | A * | 7/1994 | Holtz | 49/463 |
| 5,653,061 | A * | 8/1997 | Hiner | E04F 19/08 49/463 |
| 6,273,288 | B1 | 8/2001 | Jarvis | |
| 7,168,146 | B2 * | 1/2007 | Hord | 29/434 |
| 8,115,100 | B2 * | 2/2012 | Peckham | 174/67 |
| 8,745,926 | B2 * | 6/2014 | De Domenico | E05B 35/008 49/465 |
| 8,869,458 | B2 * | 10/2014 | Ivasiv et al. | 49/503 |
| 2009/0300884 | A1 | 12/2009 | Morgan et al. | |
| 2011/0067897 | A1 * | 3/2011 | Peckham | 174/67 |

* cited by examiner

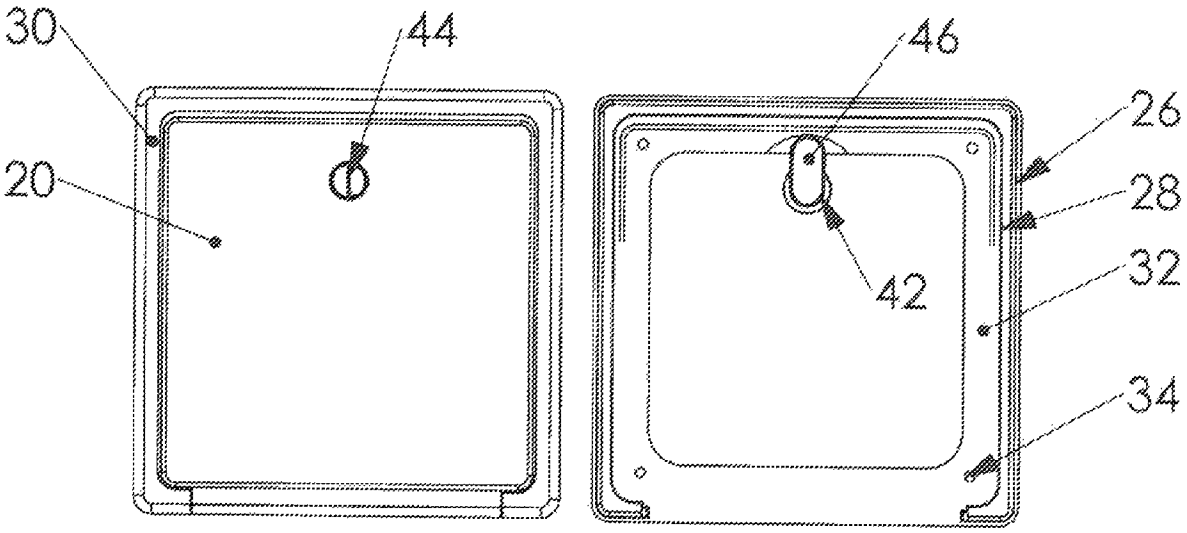
FIG 4
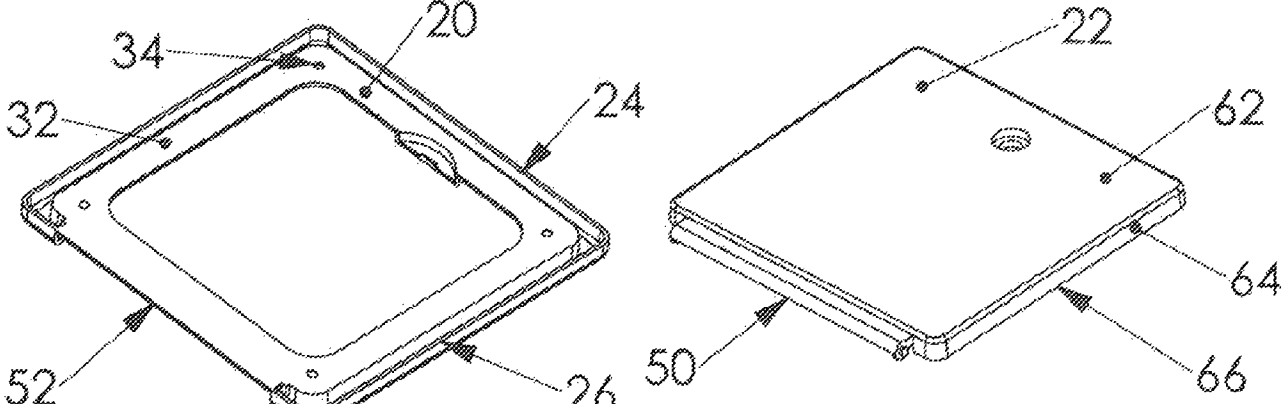
FIG 3
FIG 5

MOLDED PLASTIC ACCESS DOOR

CROSS-REFERENCE TO RELATED APPLICATIONS

This application is a continuation of U.S. patent application Ser. No. 12/722,383, filed Mar. 11, 2010, now issued as U.S. Pat. No. 8,869,458.

FIELD OF THE INVENTION

The present invention relates to access doors utilized to cover openings in walls or ceilings to permit access to services within a wall or ceiling cavity. In particular, the present invention is directed to a molded plastic access door which allows access to the full dimension of the opening.

BACKGROUND OF THE INVENTION

In residential and commercial construction, services such as water supply, drain waste vent (DWV), natural gas and electrical service are generally run within a wall or ceiling cavity. The wall or ceiling cavity is covered with a finish material such as a gypsum board to provide a finished appearance to the space. In many circumstances, it is required that access to valves, drains and connectors utilizing these services is maintained. In these situations, an opening is cut in the covering material of a size to permit access to the valve, drain or other connection. This opening is then covered by an access panel or access door which maintains the finished surface appearance while permitting access to the wall or ceiling cavity behind the panel or door.

There are presently available access panels of a molded plastic material where the access panel is provided with a spring clip on the back surface. The spring clip engages the interior surface of the wall cover material and sandwiches the covering material between the access panel and the spring clip. While such access panels are easy to install, they do not provide for a secure installation in that it is not possible to lock the panel to control access to the cavity opening. Also, the spring clip tends to loosen from the access panel with repeated use such that the average useful life of such panels is about 2 to 3 years.

Access doors constructed of metal or plastic are also known. The access doors constructed of metal are generally provided with an exterior frame having an L-shaped cross section with one leg of the L forming the exterior surface to overly the wall or ceiling covering material. The other leg of the L is provided with holes to allow for fastening of the access door to the opening in the wall or ceiling. Owing to the weight of the metal panels, it is generally necessary to provide for support such as wood strapping attached to the interior surface of the wall or ceiling covering material if the opening does not line up with an existing stud or joist in the wall or ceiling cavity. The metal door is generally provided with a hinge along one edge which is attached to one side of the frame, the door also having a locking means on the opposite side from the hinge to allow it to be closed and locked to the frame. The access door fits within the frame but is not airtight or soundproof.

Recently, plastic access doors have also been developed. These plastic access doors have an L-shaped frame similar to the metal access doors and the door itself is hinged in the opening by hinge pins which are placed interior of the edge of the door. While the plastic access door has a lower weight than the traditional metal access doors, it does suffer from certain disadvantages. Owing to the design of the door, similar to the metal access doors, the plastic access door is not airtight or soundproof. In addition, due to the placement of the hinges, the access door in the open position blocks off access to a significant portion of the opening and does not provide access to the full width of the opening. The access door must also be installed similar to the metal access doors by attaching to strapping placed on the interior surface of the covering material.

There thus remains a need for a light weight plastic access door which overcomes the disadvantages of the prior art designs.

SUMMARY OF THE INVENTION

The present invention is directed to a molded access door assembly for an access opening in a wall or ceiling. The molded access door assembly comprises a molded frame and a molded door hingedly connected to the frame. The frame comprises a frame channel to form the outside of the access door assembly, the frame channel having spaced apart exterior and interior walls joined at the top edge by a top wall. The opening in the channel is orientated toward the wall or ceiling. The frame channel has a lip extending from the bottom edge of the inner wall into the interior of the opening in a wall or ceiling, the lip providing a stop rest for the door in the closed position and being provided with a means of attaching the access door assembly to the wall or ceiling. The door has a top surface and a first part of a hinge assembly along one edge of the top surface which cooperates with a matching second part of the hinge assembly along one edge of the frame channel to allow the door to move between an open and a closed position.

In an aspect of the invention, the door assembly includes a means for releasably securing the door to the frame in the closed position.

In another aspect of the invention, the means for releasably securing the door to the frame comprises a rotatable latch which engages a latch receiving detent provided on the lip of the frame.

In yet another aspect of the invention, the latch receiving detent is raised above the lip to provide a space between the bottom of the detent and a wall or ceiling covering to receive the rotatable latch.

In a further aspect of the invention, the tab includes a raised tab which engages a recess provided in the underside of the latch receiving detent.

In yet another aspect of the invention, the first part of the hinge assembly has a generally circular hinge member with hinge pins protruding from both ends of the generally circular hinge member.

In a further aspect of the invention, the matching second part of the hinge assembly includes a cutout in the frame channel of the frame sized to accept the generally circular hinge member of the door.

In another aspect of the invention, the door has a top surface and an wall extending downwardly from the top surface around the edge of the top surface, the height of the wall being about equal to the height of the inside wall of the frame above the lip.

In yet another aspect of the invention, resilient sealing material is provided on a lower edge of the wall extending downwardly from the top surface of the door or the lip to provide for airtight or soundproof sealing between the lower edge of the wall extending downwardly from the top surface of the door and the lip.

In a further aspect of the invention, the access door assembly is molded from any suitable thermosetting or thermoplastic material such as polyvinylchloride, polystyrene, polyamides, or ABS.

In another aspect of the invention, the access door assembly is molded from an ABS material which can be colored to a suitable color to match the desired décor.

BRIEF DESCRIPTION OF THE DRAWINGS

Preferred embodiments of the present invention are illustrated in the attached drawings in which:

FIG. 3 is a front view of the access door assembly of FIG. 1;

FIG. 4 is a back view of the access door assembly of FIG. 1;

FIG. 5 is an exploded perspective view of the components of the access door assembly of FIG. 1;

DETAILED DESCRIPTION OF THE PREFERRED EMBODIMENTS

Figure 1:
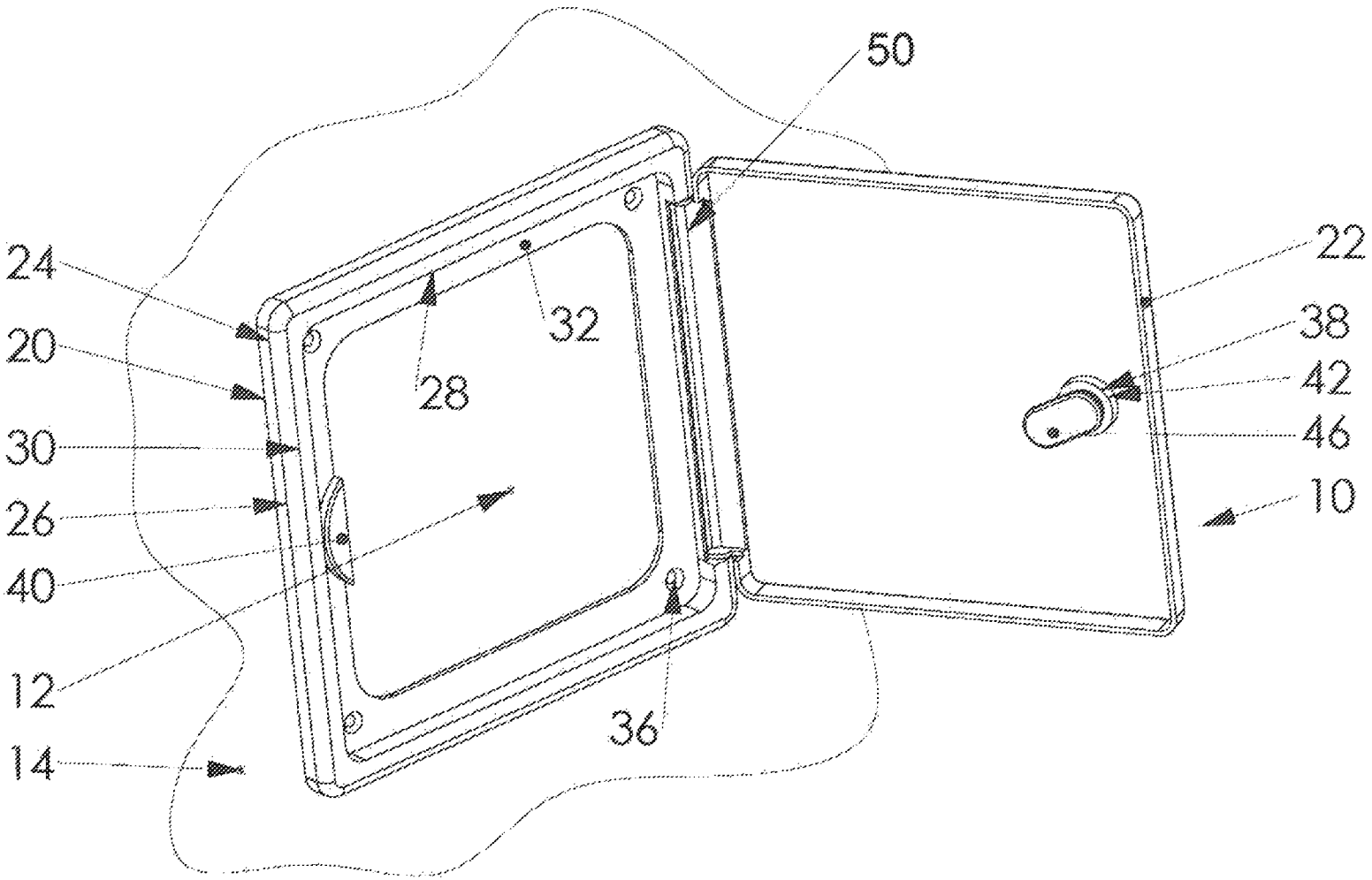
FIG. 1 is a perspective view of a preferred embodiment of the plastic access door assembly of the present invention attached to a wall opening.
Figure 2:
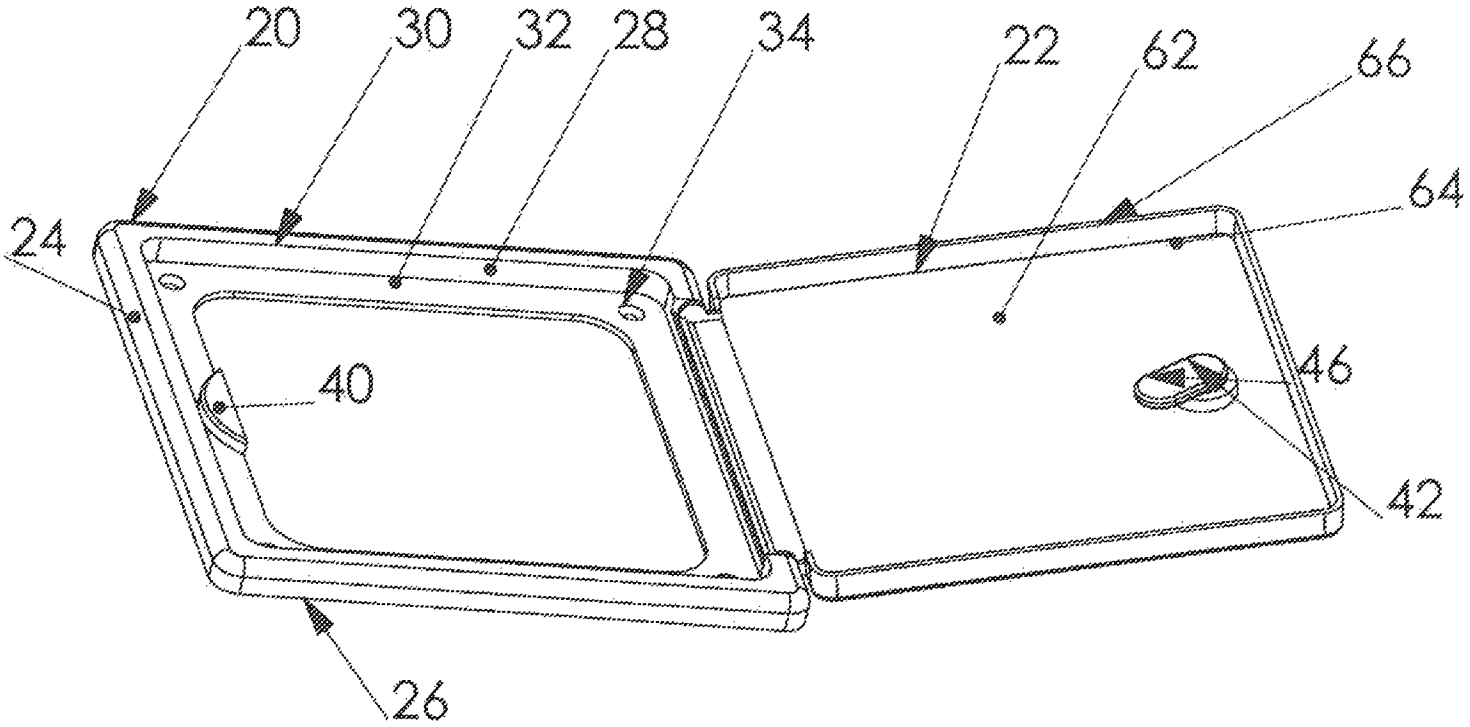
FIG. 2 is a perspective view of the access door assembly of FIG. 1.

A first preferred embodiment of an access door assembly of the present invention is illustrated in the attached drawings, generally indicated by the numeral 10. Access door assembly 10 is for attachment to a wall or ceiling surface to cover an opening 12 provided in a wall or ceiling covering material 14 to allow access to services provided within the cavity of the wall or ceiling behind the wall or ceiling covering 14.

As illustrated in the figures, the access door assembly 10 comprises a frame assembly 20 to which is hingedly attached a door 22 as will be described further below. The frame assembly 20 comprises a frame channel 24 having an outside wall 26, an inside wall 28 and a top wall 30. The frame channel 24 is orientated such that the open bottom between the outside wall 26 and inside wall 28 is orientated towards the wall or ceiling covering material 14 when the access door assembly 10 is installed. The provision of the frame channel 24 increases the rigidity of the frame assembly 20 and in turn the entire access door assembly 10 without an increase in weight or cost.

A lip 32 is provided attached to the lower edge of the inside wall 28, the lip 32 extending into the opening in the interior of the frame assembly 20. As will be described further below, one function of the lip 32 is provide for a stop and rest for the door 22 when the access door assembly 10 is in the closed position.

In addition, the lip 32 is provided with a means for attaching the access door assembly 10 to the wall or ceiling covering material 14. One such means illustrated in the drawings is the provision of holes 34 which accept suitable screws 36 for attaching the access door assembly 10 to the wall or ceiling covering 14. Preferably the holes 34 are countersunk to allow the use of countersunk screws 36 such that when the screws 36 are installed, the heads of the screws 36 lie flush with the surface of the lip 32 and do not interfere with the closing of the door 22. By providing the means for attaching the access door assembly 10 to the wall or covering material 14 on the surface of the lip 32, it is not necessary that strapping be provided in the interior of the cavity. Rather for gypsum board covering, a hole could be drilled through the covering to match up with the holes 34 in the lip 32 and a suitable wall anchor which grips and holds the screw 36 is placed within the hole. This arrangement results in a faster and easier installation of the access door assembly of the present invention as compared to the prior art arrangements.

The door 22 also includes a means for releasably securing the door 22 in the closed position. In the embodiments illustrated in the figures, the means for releasably securing the door 22 is a rotatable latch 38 which engages a latch receiving detent 40 provided on the lip 32 of the frame assembly 20. As illustrated in the drawings, in order to enable the flush mount of the frame assembly 20 to the wall or ceiling covering material 14, the latch receiving detent 40 is preferably provided as a raised detent 40 which provides a space between the bottom of the detent 40 and the wall or ceiling covering material 14 to receive the rotatable latch 38.

The rotatable latch 38 has a rotatable post 42 which is rotatable by turning a knob or key access 44 at the top of the rotatable post provided on the exterior surface of the door 22. A tab 46 is attached to the bottom of the rotatable post 42 such that the tab 46 rotates with the rotatable post 42 and engages the underside of the latch receiving detent 40 to releasably secure the door 22 in the closed position. In order to provide a more secure engagement of the tab 46 and the latch receiving detent 40, the tab 46 may be provided with a raised ridge 48 which engages with a recess 49 provided in the underside of the latch receiving detent 40. As the tab 46 on the rotatable post 42 is rotated to the closed position, the raised ridge 48 rides over the underside surface of the latch receiving indent 40 until it drops into the recess 49 and helps to hold the door 22 in the closed position. To open the door 22, the knob or key access 44 is rotated to the open position which rotates the attached rotatable post 42 and tab 46 until the raised ridge 48 on the tab 46 disengages from recess 49 of the latch receiving detent 40 and allows the door 22 to be opened.

Figure 7:
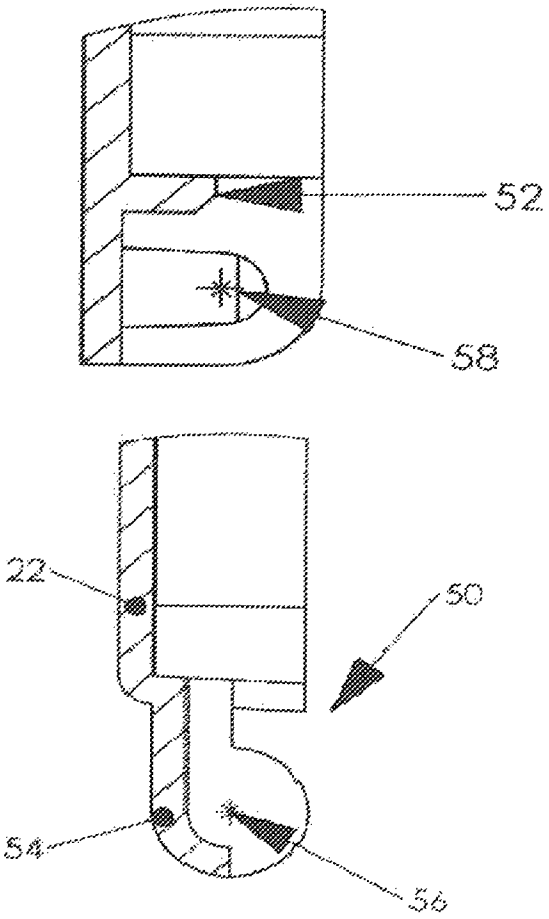
FIG. 7 is a view in cross-section of the hinge assembly.
Figure 6:
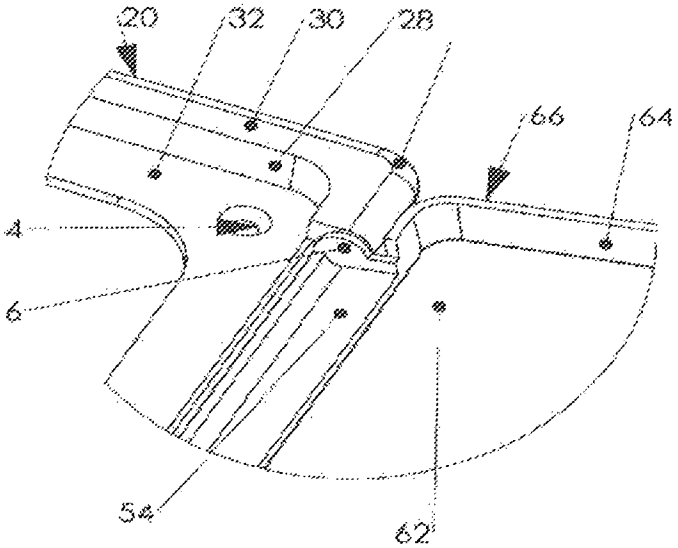
FIG. 6 is a close-up view of the hinge assembly of the access door assembly of FIG. 1.

A preferred embodiment of the hinge connection between the frame assembly 20 and door 22 is illustrated in detail in FIGS. 5 to 7. Door 22 is provided along one edge with a first part of a hinge assembly 50 along one edge and the frame assembly 20 is provided with the matching second part of the hinge assembly 52 along one edge. In the embodiment illustrated, the first part of the hinge assembly 50 has a generally circular hinge member 54 with hinge pins 56 protruding from both ends of the generally circular hinge member 54. The matching second part of the hinge assembly 52 include a cutout 58 in the frame channel 24 of the frame assembly 20 sized to accept the generally circular hinge member 54 of the door 22. Hinge pin receiving holes 60 are provided in each end of the cutout 58 to receive the hinge pins 56 of the first part of the hinge assembly 50. The hinge pins 56 in the hinge pin receiving holes 60 securely hold the door 22 to the frame assembly 20 and allow it to rotate from the open to the closed position. The provision of the first and second parts of the hinge assembly 50 and 52 on the edges of the door 22 and frame assembly 20 respectively allow the door to 22 to fully open and provide access to the full dimensions of the opening formed by the interior edges of the lip 32. This allows for a smaller dimensioned door assembly for an equivalent opening compared to the prior art plastic access doors.

As illustrated in the figures, the door 22 has a top surface 62 and an wall 64 extending downwardly from the top surface around the edge of the top surface 62. The height of the wall 64 is about equal to the height of the inside wall 28 of the frame channel 24 above the lip 32. In this way, when the access door assembly 10 is in the closed position, the lower edge 66 of the wall 64 of the door 22 rests against the lip 32 and provides a flush, finished appearance to the access door assembly 10.

The provision of the lower edge 66 of the wall 64 of the door 22 resting against the lip 32 of the frame assembly 10 also allows the access door assembly 10 of the present invention to be made airtight or soundproof. If desired, resilient sealing material such as a rubber strip could be provided on either the lower edge 66 or the lip 32 to provide for airtight or soundproof sealing between the lower edge 66 and the lip 32.

It will be appreciated by those of skill in the art that the height of the walls 64 and 28 can be varied to give a higher or lower profile to the access door assembly 10 as desired. Preferably, the height of the walls 28 and 64 is selected to allow the access door assembly 10 to match DECORA™ electrical outlets and switch plates to allow the access door assembly 10 to appear as another such plate. In addition, the access door assembly 10 of the present invention may be provided in a number of different sizes, depending upon the application. For example, for shut off valves and connectors for services such as natural gas, a 6 inch by 6 inch panel is commonly used, while for clean out fittings for DWV and shut off valves for the main water supply, sizes up to 12 inches by 12 inches or larger may be used. The access door of the present invention is easily adapted to such a variety of sizes.

The access door assembly of the present invention is molded from any suitable thermosetting or thermoplastic material such as polyvinylchloride, polystyrene, polyamides, or ABS. Preferably, the access door assembly of the present invention is molded from an ABS material which can be colored to a suitable color to match the desired decor.

The access door assembly of the present invention provides numerous advantages over the previously available access door assemblies. It is of less weight and cost compared to the prior metal door assemblies. In addition, it is easier to install, not requiring additional strapping around the wall opening to support the access door assembly. When compared to the prior plastic door assemblies, the access door assembly of the present invention provides for a larger opening access and is easier to install. In addition, the life expectancy is significantly increased.

Although various preferred embodiments of the present invention have been described herein in detail, it will be appreciated by those of skill in the art that variations may be made thereto without departing from the spirit of the invention or the scope of the appended claims.

We claim:

1. A molded access door assembly for an access opening in a wall or ceiling, the assembly comprising:

(a) a molded frame including:

an inner wall having an inner wall bottom edge for positioning against the wall or ceiling about the access opening, and an inner wall top edge spaced orthogonally away from the inner wall bottom edge, an outer wall spaced laterally outwardly from the inner wall, the outer wall having an outer wall bottom edge for positioning against the wall or ceiling about the access opening, and an outer wall top edge spaced orthogonally away from the outer wall bottom edge, a top wall extending between the inner wall top edge and the outer wall top edge, and a lip extending from the inner wall bottom edge to a lip inner edge spaced laterally inwardly from the inner wall bottom edge, the lip inner edge extending about a perimeter of a frame opening defined by the frame, the lip including a generally flat lip bottom surface for bearing against the wall or ceiling adjacent the access opening and a lip top surface opposite the lip bottom surface, the lip bottom surface and the outer wall bottom edge lying in a common bottom plane, the lip further including fastener holes passing through the lip bottom surface for receiving fasteners to secure the frame against the wall or ceiling, wherein each fastener hole is spaced laterally inwardly from the inner wall and a respective portion of the lip top surface extends laterally between each fastener hole and the inner wall; and (b) a molded door hingedly connected to the frame and movable between an open position providing access to the frame opening and the fastener holes and a closed position in which the door covers the frame opening and the fastener holes.

2. The assembly of claim 1 further comprising hinge pins protruding outwardly from opposing surfaces of the door, wherein the frame includes hinge pin receiving holes receiving the hinge pins to hingedly connect the door to the frame.

3. The assembly of claim 1, wherein the lip inner edge extends about an entirety of the perimeter of the frame opening.

4. The assembly of claim 1, wherein the lip is generally perpendicular to the inner wall.

5. The assembly of claim 1, wherein the lip has a lateral extent between the inner wall bottom edge and the lip inner edge, the lateral extent generally constant about the perimeter of the frame opening.

6. The assembly of claim 1, wherein the lip top surface provides a stop rest for the door when the door is in the closed position.

7. The assembly of claim 1, wherein the frame includes four corners where perpendicular sides of the frame intersect, and the lip extends generally continuously from one to another of the perpendicular sides through a respective corner.

8. The assembly of claim 7, wherein the frame includes four fastener holes, each of the four fastener holes adjacent a respective one of the four corners.

9. The assembly of claim 1, wherein the inner wall has an inner wall axial extent between the inner wall bottom edge and the inner wall top edge, and the outer wall has an outer wall axial extent between the outer wall bottom edge and the outer wall top edge, the inner wall axial extent generally equal to the outer wall axial extent.

10. The assembly of claim 1, wherein the lip is generally parallel to the top wall.

11. The assembly of claim 1, wherein the frame is bounded axially by the common bottom plane.

12. The assembly of claim 1, wherein the lip bottom surface extends continuously about an entirety of the frame opening.

13. The assembly of claim 1, wherein the lip bottom surface extends continuously from the inner wall bottom edge to the lip inner edge.

14. The assembly of claim 1, wherein the door includes a door top surface and the top wall includes a top wall top surface, the door top surface and the top wall top surface lying in a common top plane when the door is in the closed position.

15. The assembly of claim 14, wherein the frame and the door are bounded axially by the common top plane when the door is in the closed position.

16. The assembly of claim 1, further comprising a detent surface fixed to the frame axially intermediate the lip and the inner wall top edge; and a latch rotatably mounted to the door, the latch rotatable relative to the door between an engagement position for engagement with the detent surface to secure the door to the frame when the door is in the closed position, and a disengaged position in which the latch is clear of the detent surface for permitting movement of the door between the open and closed positions.

17. The assembly of claim 16, wherein the detent surface is spaced laterally inwardly from the inner wall.

18. The assembly of claim 16, wherein the detent surface is laterally intermediate the inner wall and the lip inner edge.

19. The assembly of claim 16, wherein the latch is axially intermediate the inner wall bottom edge and the detent surface when the door is in the closed position.

20. The assembly of claim 16, wherein the latch is spaced laterally inwardly from the inner wall when the door is in the closed position and the latch is in the engagement position.

21. A molded access door assembly for an access opening in a wall or ceiling, the assembly comprising:

(a) a molded frame including:

an inner wall having an inner wall bottom edge for positioning against the wall or ceiling about the access opening, and an inner wall top edge spaced orthogonally away from the inner wall bottom edge, a lip extending from the inner wall bottom edge to a lip inner edge spaced laterally inwardly from the inner wall bottom edge, the lip inner edge extending about a perimeter of a frame opening defined by the frame, the lip including fastener holes for receiving fasteners to secure the frame against the wall or ceiling;

(b) a molded door hingedly connected to the frame and movable between an open position providing access to the frame opening and the fastener holes and a closed position in which the door covers the frame opening and covers an entirety of the fastener holes;

(c) a detent surface fixed to the frame axially intermediate the lip and the inner wall top edge; and (d) a latch rotatably mounted to the door, the latch rotatable relative to the door between an engagement position for engagement with the detent surface to secure the door to the frame when the door is in the closed position, and a disengaged position in which the latch is clear of the detent surface for permitting movement of the door between the open and closed positions.

22. The assembly of claim 21, wherein the detent surface is spaced laterally inwardly from the inner wall.

23. The assembly of claim 21, wherein the detent surface is laterally intermediate the inner wall and the lip inner edge.

24. The assembly of claim 21, wherein the latch is axially intermediate the inner wall bottom edge and the detent surface when the door is in the closed position.

25. The assembly of claim 21, wherein the latch is spaced laterally inwardly from the inner wall when the door is in the closed position and the latch is in the engagement position.

26. A molded access door assembly for an access opening in a wall or ceiling, the assembly comprising:

(a) a molded frame including:

an inner wall having an inner wall bottom edge for positioning against the wall or ceiling about the access opening, and an inner wall top edge spaced orthogonally away from the inner wall bottom edge, an outer wall having an outer wall bottom edge for positioning against the wall or ceiling about the access opening, and an outer wall top edge spaced orthogonally away from the outer wall bottom edge, a top wall extending between the inner wall top edge and the outer wall top edge, and a lip extending from the inner wall bottom edge to a lip inner edge spaced laterally inwardly from the inner wall bottom edge, the lip inner edge extending about a perimeter of a frame opening defined by the frame, the lip including a generally flat lip bottom surface for bearing against the wall or ceiling adjacent the access opening and a lip top surface opposite the lip bottom surface, the lip bottom surface and the outer wall bottom edge lying in a common plane, the access door assembly bounded axially by the common plane, and the lip further including fastener holes passing through the lip bottom surface for receiving fasteners to secure the frame against the wall or ceiling, wherein each fastener hole is spaced laterally inwardly from the inner wall and a respective portion of the lip top surface extends laterally between each fastener hole and the inner wall;

(b) a molded door hingedly connected to the frame and movable between an open position providing access to the frame opening and the fastener holes and a closed position in which the door covers the frame opening and the fastener holes;

(c) a detent surface fixed to the frame axially intermediate the lip and the inner wall top edge and laterally intermediate the inner wall and the lip inner edge; and (d) a latch rotatably mounted to the door, the latch axially intermediate the inner wall bottom edge and the detent surface when the door is in the closed position, and the latch rotatable relative to the door between an engagement position for engagement with the detent surface to secure the door to the frame when the door is in the closed position, and a disengaged position in which the latch is clear of the detent surface for permitting movement of the door between the open and closed positions.

* * * * *